US009437100B2

(12) United States Patent
Zwirn

(10) Patent No.: US 9,437,100 B2
(45) Date of Patent: Sep. 6, 2016

(54) SUPERVISING ALARM NOTIFICATION DEVICES

(71) Applicant: Jeffrey D. Zwirn, Tenafly, NJ (US)

(72) Inventor: Jeffrey D. Zwirn, Tenafly, NJ (US)

( * ) Notice: Subject to any disclaimer, the term of this patent is extended or adjusted under 35 U.S.C. 154(b) by 17 days.

(21) Appl. No.: 14/531,587

(22) Filed: Nov. 3, 2014

(65) Prior Publication Data

US 2015/0123782 A1 May 7, 2015

Related U.S. Application Data

(60) Provisional application No. 61/899,216, filed on Nov. 2, 2013.

(51) Int. Cl.
*G08B 29/00* (2006.01)
*G08B 29/12* (2006.01)
*G08B 19/00* (2006.01)

(52) U.S. Cl.
CPC ..... *G08B 29/126* (2013.01); *G08B 19/005* (2013.01)

(58) Field of Classification Search
CPC ..... G08B 29/00; G08B 5/00; G08B 29/126; G08B 19/005; H05B 39/00
See application file for complete search history.

(56) References Cited

U.S. PATENT DOCUMENTS 3,611,362 A * 10/1971 Scott ..... G08B 29/10 327/473
3,676,680 A * 7/1972 Scheidweiler ..... G08B 17/11 250/381
3,707,708 A * 12/1972 Dan ..... H04M 11/04 340/327
3,936,821 A * 2/1976 Cooper ..... G08B 23/00 340/510
4,038,649 A * 7/1977 Dobrzanski ..... G08B 27/00 250/381
4,060,803 A * 11/1977 Ashworth, Jr. .... G08B 13/1672 340/506
4,224,538 A * 9/1980 Cholin ..... G08B 29/04 169/61
4,247,847 A 1/1981 Gontowski, Jr.
4,506,254 A * 3/1985 Right ..... G08B 29/02 340/506
4,881,058 A * 11/1989 Berry, III ..... G08B 27/00 340/326
5,243,328 A * 9/1993 Lee ..... G08B 13/1418 340/538
5,574,429 A 11/1996 Streeter
5,774,044 A * 6/1998 Hayashi ..... B60R 25/1018 180/287
6,313,744 B1 11/2001 Capowski et al.

(Continued)

OTHER PUBLICATIONS

Altronix, "AL602ULADA NAC Power Extender," Installation Guide, 17 pages (2009).

(Continued)

*Primary Examiner* — Hai Phan
*Assistant Examiner* — Son M Tang
(74) *Attorney, Agent, or Firm* — Fish & Richardson P.C.

(57) ABSTRACT

In an example implementation, a system includes a control module, one or more electric circuits, each electric circuit including a resistor and one or more notification devices in parallel, and a supervisor module electrically coupled to the control module and the electric circuits. The supervisor module is configured to receive input electric power, the input electric power having a voltage in a range of 12 to 16 VDC, and apply, to each electric circuit, first electric power having a first polarity and a voltage of approximately 12 VDC. The supervisor module is also configured to determine, based on electric power returning from each electric circuit, an operational state of each respective electric circuit, and receive, from the control module, a trigger signal indicative of an alarm event. The supervisor module is also configured to, responsive to receiving the trigger signal, apply, to at least one electric circuit, second electric power having a second polarity opposite the first polarity and a voltage of approximately 12 VDC.

21 Claims, 3 Drawing Sheets

(56) References Cited

U.S. PATENT DOCUMENTS

| | | | | |
|---|---|---|---|---|
| RE38,183 | E * | 7/2003 | Kosich | H05B 41/34 315/200 A |
| 7,187,280 | B2 | 3/2007 | Ko | |
| 8,228,182 | B2 | 7/2012 | Orsini et al. | |
| 8,383,994 | B2 | 2/2013 | Rashid et al. | |
| 8,558,711 | B2 | 10/2013 | Savage, Jr. et al. | |
| 2010/0033336 | A1 * | 2/2010 | Jones | G08B 21/16 340/632 |

OTHER PUBLICATIONS

Altronix, "AL602ULADA NAC Power Extenders," 2 pages (2013).
Altronix, "AL602ULADA(J), AL802ULADA(J), AL10027LADA(J) NAC Power Extenders," Application Guide, 8 pages (2010).
Bosch, "D192G Notification Appliance Circuit (NAC) Module," 3 pages (2014).

* cited by examiner

SUPERVISING ALARM NOTIFICATION DEVICES

CROSS-REFERENCE TO RELATED APPLICATION(S)

This application claims the benefit of priority of U.S. Provisional Patent Application No. 61/899,216, filed on Nov. 2, 2013, the contents of which are incorporated herein by reference in their entirety.

TECHNICAL FIELD

This invention relates to residential alarm systems, and more particularly to supervising the operation of notification devices for alarm systems.

BACKGROUND

Alarm systems are often used to warn users of potentially dangerous conditions. For example, an alarm system for a residential structure (e.g., a house, apartment, or condominium) can include an alarm system that warns the structure's occupants of hazards such as smoke, fire, and security breaches (e.g., intrusions or burglaries). An alarm system can provide auditory and/or visual warnings, for instance by emitting a warning sound (e.g., using a siren, horn, bell, or speaker), and/or displaying a visual warning (e.g., using a flashing strobe light). To increase the likelihood that a user will be adequately warned in the event of a hazardous situation, alarm systems can be tested periodically to verify that they are functioning as intended.

SUMMARY

Implementations of an alarm system are described below. Alarm systems are often used to warn users of potentially unsafe conditions. For example, in response to a hazardous situations such as smoke, fire, and security breaches, an alarm system can notify users through auditory and/or visual warnings. In some cases, an alarm system can be implemented such that it conforms to one or more standardized sets of specifications (e.g., industry standards and/or listings), and can be configured for specific applications (e.g., residential premises, rather than commercial premises). In some cases, the alarm system can monitor the functionality of one or more of its components, and can determine if one or more of its components are performing abnormally. In response, the alarm system can notify users of the abnormality, so that they and/or their installer can perform appropriate corrective actions to restore system functionality.

Implementations of the disclosed alarm systems can provide various benefits. For example, in some cases, the alarm system can be installed in a residential location, such that it is compatible with pre-existing and/or newly installed residential systems (e.g., pre-existing and/or new electrical systems and/or alarm components). Moreover, implementations can be tailored for use in residential applications (e.g., by conforming to residential code requirements). Further, unneeded features are not included unnecessarily, thereby reducing the cost of installation, service, and maintenance. Further still, implementations of the disclosed alarm systems assess the condition and integrity of the alarm system itself, either automatically or semi-automatically, and can alert users to problems shortly after the problem occurs. In some cases, these problems might have otherwise been undetected or unknown to the end user and/or to a remote monitoring station. Thus, the alarm system increases the likelihood that a user and/or remote monitoring station becomes aware of the problem, and increases the likelihood that an appropriate corrective action is performed to restore system functionality.

In general, in an aspect, a system includes a control module, one or more electric circuits, each electric circuit including a resistor and one or more notification devices in parallel, and a supervisor module electrically coupled to the control module and the electric circuits. The supervisor module is configured to receive input electric power, the input electric power having a voltage in a range of 12 to 16 VDC. The supervisor module is also configured to apply, to each electric circuit, first electric power having a first polarity and a voltage of approximately 12 VDC. The supervisor module is also configured to determine, based on electric power returning from each electric circuit, an operational state of each respective electric circuit. The supervisor module is also configured to receive, from the control module, a trigger signal indicative of an alarm event. The supervisor module is also configured to, responsive to receiving the trigger signal, apply, to at least one electric circuit, second electric power having a second polarity opposite the first polarity and a voltage of approximately 12 VDC.

Implementations of this aspect may include or more of the following features.

In implementations, each notification device can be configured to restrict a flow of electric current through the notification device when the first electric power is applied to the corresponding electric circuit.

In implementations, each notification device can be configured to allow a flow of electric current through the notification device when the second electric power is applied to the corresponding electric circuit, and wherein the flow of electric current activates the notification device. The notification devices can be operable to emit an auditory alert when activated.

In implementations, the system can further include a transformer, where the transformer is configured to convert electric power received from a power source into the input electric power, where the electric power received from the power source has a voltage of approximately 120 VAC, and apply the input electric power to the supervisor module. The transformer can include an electrical plug configured to be insertable into a household electric socket, and wherein the transformer is configured to convert electric power received from the household electric socket into the input electric power.

In implementations, the supervisor module can be further configured to determine whether the operational state of one or more electric circuits corresponds to a fault state, and responsive to determining that the operational state of one or more electric circuits corresponds to a fault state, transmitting a fault signal to the control module. Determining that the operational state of one or more electric circuits corresponds to a fault state can include determining that no electrical power is returning from the one or more electric circuits.

In implementations, the supervisor module can include a battery module, where the supervisor module is further configured to electrically charge the battery module using at least a portion of the input electric power, and where the battery module is configured to provide backup electrical power to the supervisor module. The supervisor module can be further configured to determine an operational state of the battery module, and responsive to determining that the operational state of battery module corresponds to a fault state, transmitting a fault signal to the control module. Determining that the operational state of the battery module corresponds to a fault state can include determining that the battery module is depleted.

In general, in another aspect, an apparatus for monitoring an electric circuit of an alarm system includes a supervisor module electrically coupled to an electric circuit, the electric circuit including a resistor and one or more notification devices in parallel. The supervisor module is configured to receive input electric power, the input electric power having a voltage in a range of 12 to 16 VDC. The supervisor module is also configured to apply, to the electric circuit, first electric current in a first direction, where the voltage across the electric circuit is approximately 12 VDC when the first electric current is being applied. The supervisor module is also configured to determine, based on electric current returning from the electric circuit, an operational state of the electric circuit. The supervisor module is also configured to receive a trigger signal indicative of an alarm event. The supervisor module is also configured to, responsive to receiving the trigger signal, apply, to the electric circuit, second electric current in a second direction opposite the first direction, where the voltage across the electric circuit is approximately 12 VDC when the second electric current is being applied.

Implementations of this aspect may include or more of the following features.

In implementations, when the supervisor module applies the first electric current to the electric circuit, the notification devices can be inactive.

In implementations, when the supervisor module applies the second electric current to the electric circuit, the notification devices can be active In implementations, the notification devices can be operable to emit an auditory alert when active.

In implementations, the system can be configured to operate in accordance with a residential industry standard. The residential industry standard can be one of UL 985, UL 1635, and UL 1023.

In implementations, the supervisor module can be further configured to determine whether the operational state of the electric circuits corresponds to a fault state, and responsive to determining that the operational state of one or more electric circuits corresponds to a fault state, generating a fault signal. Determining that the operational state of the electric circuits corresponds to a fault state can include determining that no electric current is returning from the electric circuit.

In general, in another aspect, a method of monitoring an electric circuit of an alarm system includes receiving input electric power, the input electric power having a voltage in a range of 12 to 16 VDC. The method also includes applying, to the electric circuit, first electric current in a first direction, where the voltage across the electric circuit is approximately 12 VDC when the first electric current is being applied. The method also includes determining, based on electric current returning from the electric circuit, an operational state of the electric circuit. The method also includes receiving a trigger signal indicative of an alarm event. The method also includes responsive to receiving the trigger signal, applying, to the electric circuit, second electric current in a second direction opposite the first direction, where the voltage across the electric circuit is approximately 12 VDC when the second electric current is being applied.

The details of one or more implementations are set forth in the accompanying drawings and the description below. Other aspects, features and advantages will be apparent from the description and drawings, and from the claims.

DETAILED DESCRIPTION

Figure 1:
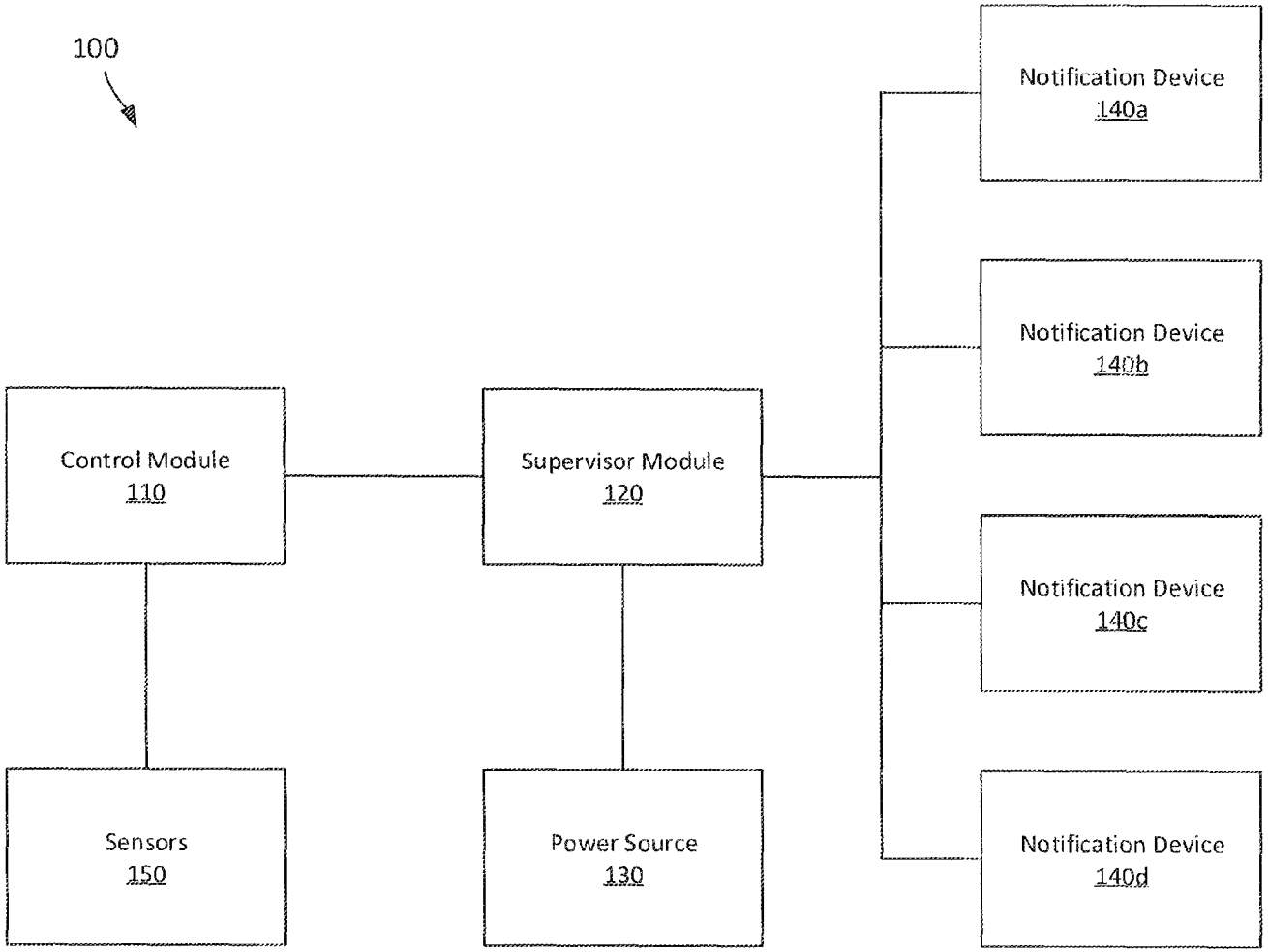
FIG. 1 is a diagram of an example alarm system.

Alarm systems are often used to warn users of potentially unsafe conditions. For example, in response to a hazardous situations such as smoke, fire, or security breaches, an alarm system can notify users through auditory and/or visual warnings. In response, the user can take an appropriate course of action.

For example, an alarm system that warns users through auditory notifications (e.g., using a siren, horn, bell, or speaker) can emit those notifications at a sufficiently high level of loudness, such that those notifications can be readily heard by users in a particular area. Similarly, an alarm system that warns users through visual warnings (e.g., using a flashing light or strobe, or using a sustained light) can emit those notifications with sufficient brightness and visibility, such that those notifications can be readily seen by users in a particular area.

In some cases, the alarm system itself also can initiate a course of action in response to detecting a hazardous situation. For example, in some implementations, an alarm system can transmit a signal (e.g., an alert message) to a remote monitoring station to alert others of the situation (e.g., the local police, if a burglar alarm activates, and/or the fire department if a smoke detector activates, and so forth).

In some cases, an alarm system can be implemented such that it conforms to one or more standardized sets of specifications (e.g., industry standards, codes and/or listings). Standards can define various aspects of an alarm system's construction and operation. For example, standards can define the structural characteristics and features of the alarm system's components (e.g., dimensions, materials, wiring configuration, electrical configuration, installation location, and so forth). Standards also can define the operating characteristics of the alarm system (e.g., input/output signal characteristics, the pattern and intensity of the notifications generated by the alarm system, criteria for generating the notifications, and so forth). Example standards include those defined by Underwriters Laboratories, Inc. (UL) and the National Fire Protection Association (NFPA).

For instance, standards can include the following: NFPA 72 (1993, 1996, 1999, 2002, and 2007 editions), NFPA 72 (2010 and 2013 editions), NFPA 70 (1990, 1993, 1996, 1999, 2002, 2005, 2008, 2011, and 2014 editions), UL 268 (First Edition—September, 1979; Second Edition—June, 1981; Third Edition—May, 1989; Fourth Edition—December, 1996; Fifth Edition—September, 2006; Sixth Edition—Aug. 14, 2009), UL 636 (First Edition—July, 1933; Second Edition—June, 1945; Third Edition—November, 1952; Fourth Edition—February, 1958; Fifth Edition—September, 1972; Sixth Edition—July, 1973; Seventh Edition—August, 1978; Eighth Edition—July, 1980; Ninth Edition—June, 1987; Tenth Edition-Nov. 26, 1996), UL 639 (First Edition—April, 1964; Second Edition—October, 1969; Third Edition—December, 1971; Fourth Edition—September, 1978; Fifth Edition—September, 1986; Sixth Edition—July, 1993; Seventh Edition—February, 1997; Eighth Edition—

Aug. 31, 2007), UL 985 (First Edition—January, 1973; Second Edition—April, 1980; Third Edition—June, 1985; Fourth Edition—July, 1994; Fifth Edition—May 26, 2000), UL 1023 (First Edition—March, 1972; Second Edition—August, 1978; Third Edition—October, 1978; Fourth Edition—September, 1985; Fifth Edition—September, 1991; Sixth Edition—Nov. 25, 1996), UL 1635 (First Edition—January, 1985; Second Edition—February, 1991; Third Edition—Jan. 31, 1996), UL 2034 (First Edition—April, 1992; Second Edition—October, 1996; Third Edition—Feb. 28, 2008), UL 2075 (First Edition—November, 2004; Second Edition—Mar. 5, 2013), UL 864 (First Edition—October, 1948; Second Edition—September, 1957; Third Edition—February, 1972; Fourth Edition—September, 1972; Fifth Edition—January, 1975; Sixth Edition—June, 1980; Seventh Edition—May, 1991; Eighth Edition—November, 1996; Ninth Edition—Sep. 30, 2003), and UL 365 (First Edition—March, 1975; Second Edition—July, 1982; Third Edition—June, 1993; Fourth Edition—Jul. 31, 1997), all of which are incorporated herein in their entirety.

In some cases, standards relate to a particular intended use of the alarm system. For example, alarm systems intended for use in a residential environment can be defined by one set of standards and codes (e.g., UL 985 and/or UL 1023, and/or UL 1635 and NFPA 720, NFPA 70 and/or NFPA 72), while alarm systems intended for use in a commercial environment can be defined by a different set of standards and codes (e.g., UL 864, and/or UL 365 and NFPA 720, NFPA 70 and/or NFPA 72). In some cases, an alarm system can be configured specifically for use in a residential environment, such that it conforms with residential codes, standards, and listings (e.g., UL 985 and/or UL 1023, and/or UL 1635, and NFPA 720, NFPA 70 and/or NFPA 72), and is fully compatible with other components or systems specifically designed for use in a residential environment. This can be beneficial, as it allows the alarm system to perform in a predictable and reliable manner, either alone or in conjunction with other devices.

To increase the likelihood that a user will be warned adequately in the event of a hazardous situation, alarm systems can be tested to verify that they are functioning as intended. For instance, the alarm system can be tested during installation to ensure that it is capable of providing notifications that can be readily seen or heard within one or more particular areas (e.g., one or more areas throughout a protected premise) and under a variety of conditions. As an example, the alarm system can be calibrated such that it is capable of delivering auditory alerts at a sufficient high level of loudness to a specific location (e.g., at least 15 dBA over the ambient noise level in the home at the location of the user's bed for at least 60 seconds). After the installation is completed, the alarm system also can be tested to ensure that it remains capable of providing these same audible notifications. As an example, various components of the alarm system (e.g., the power source, wiring, notification systems, and control systems) can be tested to ensure that the alarm system remains capable of providing sufficiently loud or visible notifications within the protected premises (e.g., in accordance with codes and standard requirements which are mandated by the authority having jurisdiction).

In some cases, this testing can be performed by the alarm system itself, either automatically or semi-automatically, such that a user need not evaluate and test the system manually. If the alarm system detects an abnormal condition (e.g., if it detects that one or more of its components is malfunctioning or is otherwise not functioning as intended), the alarm system can notify the user of this condition (e.g., by generating an audible and/or visual notification at the protected premises). The alarm system can also notify a remote monitoring station to notify others of the condition. In many cases, this increases safety and reliability of the alarm system, and increases the likelihood that problems with the alarm system will be detected before an emergency occurs. Furthermore, it can relieve the user of the need to periodically assess the condition of every component of the alarm system himself. This also can be beneficial, for example, as components of an alarm system are often installed in multiple locations within a structure, and may be installed in such a way that they are difficult to access (e.g., within walls, on high ceilings, and so forth). Thus, a self-supervising alarm system can be used to test components from multiple locations more quickly, and can be used to test components that might otherwise be impractical to test manually. Further, this also can be beneficial, as it alerts the users to problems shortly after the problem occurs, allowing the user to promptly take an appropriate course of action in response (e.g., repair the alarm system and/or have the alarm system repaired by a third party, such as an alarm contractor).

An example of a self-supervising alarm system 100 is shown in FIG. 1. The alarm system 100 includes a control module 110, a supervisor module 120, a power source 140, multiple notification devices 140*a-d*, and sensors 150. Each of the components of the alarm system 100 are electrically coupled, such that they can exchange electric current (e.g., electric power and/or electric signals).

The control module 110 (sometimes referred to as a host control panel) controls various aspects of the alarm system 100. For example, the control module 110 receives measurement information from one or more sensors 150 in order to determine if a trigger condition has been met (e.g., by determining if the measurements have met or exceeded a particular threshold). For instance, one or more sensors 150 can be electrically coupled to the control module 110, and can provide the control module 110 with information regarding a particular location. Example sensors 150 include devices such as carbon monoxide sensors, smoke detectors, temperature sensors, door sensors, and motion sensors that are positioned at various locations of a user's house. Each sensor 150 measures particular properties (e.g., a presence and/or concentration of carbon monoxide, a presence of smoke, a temperature, a presence of motion, and so forth), and transmits these measurements to the control module 110. In some cases, the transmitted measurements can be binary information (e.g., an indication if a particular condition has been detected). In some cases, the transmitted measurements can indicate varying degrees of conditions (e.g., a particular value on a scale). In some cases, the transmitted measurements can indicate varying degrees of conditions with respect to reference conditions (e.g., a particular absolute or relative deviation from a reference value).

The control module 110 also presents information to the user, and allows the user to input commands. For example, the control module 110 can include a display device (e.g., a display screen, LCD display, and/or LEDs) that presents information regarding the operational parameters of the alarm system 100 (e.g., the power state of the alarm system, the alarm state of the alarm system, the specified trigger conditions, abnormalities, faults, and so forth). The control module 110 also can include input devices (e.g., buttons, dials, switches, keypads, touch screens) that allow a user to enter commands. For example, the user can use the input devices to activate the alarm system 100, specify customized trigger conditions, zones, and so forth). The control module

110 can be configured to provide information to authorized day-to-day users (e.g., the residents of a structure), as well as to emergency responders (e.g., police officers and/or firefighters that were dispatched in response to an alarm notification). For example, in some cases, the control module 110 can function as a burglar and/or fire alarm control panel that allows a responder to be able to pinpoint and identify the location of the alarm event at the protected premises and/or utilize the provided information during an emergency situation.

In some cases, the control module 110 also can transmit information to remote systems (e.g., remote computer systems and/or users). For example, the control module 110 can include, or otherwise have access too, a communications module that allows it to transmit information over a communications network (e.g., a telephone network, a cellular network, a long range radio network, a satellite communications network, a local area network (LAN), a wide area network (WAN), the internet, or any other network). The control module 110 can transmit information regarding the operational status of the alarm system 100, as well as information regarding conditions detected by the alarm system 100 (e.g., regarding any trigger conditions that were detected corresponding to emergencies, such as trigger conditions related to fire, carbon monoxide, heat, burglary, panic, holdup, water detection, abnormal environmental conditions, and so forth). In some implementations, the alarm system 100 can be monitored by a remote monitoring station (e.g., a central monitoring station tasked with remotely monitoring and responding to alarm and trouble conditions detected by the alarm system 100), such that the monitoring station can take an appropriate course of action (e.g., request assistance from the fire and/or police department). In some cases, the control module 110 can be configured to transmit information to a monitoring station within a particular period of time (e.g., within 90 to 200 seconds of an event occurring), such that information is transmitted and received in a timely manner.

The control module 110 can be implemented in digital electronic circuitry, or in computer software, firmware, or hardware, or in combinations of one or more of them. For example, in some cases, the control module 110 can be implemented as one or more electronic circuits, hardware components with integrated circuits, generalized processors that executes instructions, or combinations thereof.

The position of the control module 110 can vary, depending on the application. For example, the control module 110 can be placed in a user-accessible location (e.g., mounted on a wall of a dwelling), such that the user can readily access and view the control module 110 and input commands into the control module 110. The other components of the alarm system 100 can be placed relatively nearby the control module 110 (e.g., within a few feet) and/or relatively remote from the control module 110 (e.g., further than a few feet), depending on the implementation.

The notification devices 140*a-d* warn a user by generating and emitting a notifications in the protected premises. In some cases, the notification devices 140*a-d* can include one or more devices that generate auditory feedback (e.g., a siren, a horn, a bell, or a speaker). When activated, the notification devices 140*a-d* generates an auditory notification (e.g., a loud and distinctive noise and/or sound) in order to warn the occupants of the premises. In some cases, the notification devices 140*a-d* can include one or more devices that generate distinctive signals, so that the occupants of the home can determine the type of emergency alarm event which was detected by the system (e.g., fire, carbon monoxide, or an intrusion) based on the generated sound. For example, in some cases, a sustained sound can indicate a burglar or intruder has been detected, a "temporal 3" sound can indicate that smoke has been detected, and a "temporal 4" sound can indicate that excessive carbon monoxide has been detected.

In some cases, the alarm system can generate visual feedback (e.g., a light or strobe). For example, when activated by the control module 110, the notification devices 140*a-d* generates a visual notification (e.g., a bright light) in order to warn the user. In some cases, a visual notification can be generated on the exterior of a premises (e.g., a flashing light positioned on the outside of the premises), such that people outside of the premises are warned. This can also be beneficial, as it can identify a particular structure or premises that is experiencing a dangerous condition. In some cases, a visual notification can be generated on the interior of the premises (e.g., a sustained light positioned on the interior of the premises), such that people inside of the premises are warned. This can also be beneficial, as it can provide the occupants with increased visibility (e.g., by providing additional illumination) that would allow them to navigate the premises more easily.

The supervisor module 120 manages the operation of the notification devices 140*a-d*. For example, the supervisor module 120 is electrically coupled to the control module 110 and the notification devices 140*a-d*. During operation, the supervisor module 120 receives a signal from the control module 110, indicating that one or more of the notification devices 140*a-d* should be activated. In response, the supervisor module 120 activates the appropriate notification devices 140*a-d* in order to generate and emit the audible notification devices 140*a-d*. The supervisor module 120 also monitors each of the notification device 140*a-d* to determine if they are functioning correctly. If any abnormalities are detected within the notification devices 140*a-d*, the supervisor module 120 can transmit signals indicating these abnormalities to the control module 110. The supervisor module 120 also determines if the alarm system 100 has access to a sufficient amount of electric power to properly function. If any abnormalities are detected, the supervisor module 120 also can transmit signals indicating these abnormalities to the control module 110.

The supervisor module 120 can be implemented in digital electronic circuitry, or in computer software, firmware, or hardware, or in combinations of one or more of them. For example, in some cases, the supervisor module 120 can be implemented as one or more electronic circuits, hardware components with integrated circuits, generalized processors that executes instructions, or combinations thereof.

The position of the supervisor module 120 with respect to the other components of the alarm system 100 can vary, depending on the application. For example, in some cases, the supervisor module 120 can be positioned relatively nearby one or more of the notification devices 140*a-d*. In some cases, the supervisor module 120 can be positioned relatively remote from one or more of the notification devices 140*a-d*. In some cases, the supervisor module 120 can be positioned relatively nearby the control module 110 (e.g., mounted on a wall nearby the control module 110).

The power source 130 provides electric power to the supervisor module 120. In some cases, the power source 130 only provides electric power to the supervisor module 120. However, in some cases, the power source 130 also can provide electric power to one or more of the other components of the alarm system 100 as well. For example, in some implementations, the power source 130 can provide electric power to the control module 110, the sensors 150, and/or the notification devices 140*a-d*. Various types of power sources can be used. For example, the power sources 130 can be a remotely located source of power (e.g., an electric generator or a regional electrical grid) and/or receive power from a remotely located source of power. As another example, the power source 130 can include one or more devices that store electric energy (e.g., electrochemical cells or batteries) and release stored electric energy as needed. Although a single power source 130 is shown, in some cases, there may be multiple power sources 130, and each can power one or more of the components of the alarm system 100, either individually or in combination with other power sources 130.

Figure 2:
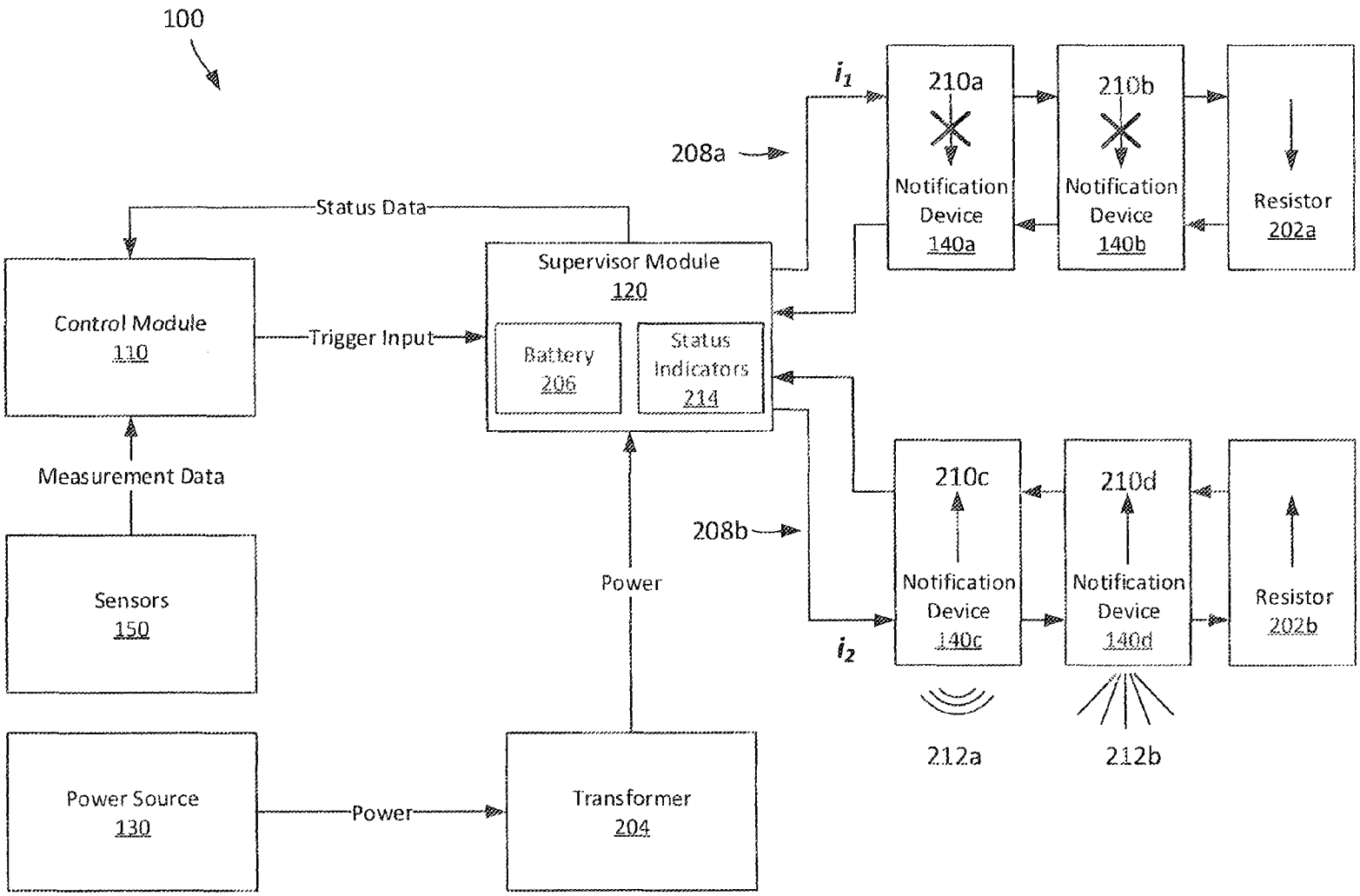
FIG. 2 is a diagram showing the operation of an example alarm system.

An example operation of an alarm system 100 is shown in FIG. 2. In the example shown in FIG. 2, the alarm system includes a control module 110, a supervisor module 120, a power source 130, multiple notification devices 140*a-d*, a sensor 150, resistors 202*a-b*, a transformer 204, a battery 206, and status indicators 214. Each of the components of the alarm system 100 are electrically coupled, such that they can exchange electric current (e.g., electric power and/or electric signals).

As described above, the control module receives measurement data from one or more sensors 150 in order to determine if a trigger condition has been met. This measurement data can include, for example, information regarding a presence and/or concentration of carbon monoxide, a presence of smoke, a presence of the particles of combustion, a temperature, a presence of motion, or any other measurement data obtained by the sensor 150. In some cases, multiple sensors 150 can be distributed in one or more locations (e.g., one or more sensors 150 in the same room, or one or more sensors 150 in each of several different rooms). In some cases, multiple different types of sensors 150 can be positioned in approximately the same location (e.g., in the same room), in order to obtain multiple different types of measurements and/or changes in the environment. In this manner, a wide range of information can be collected about a location and its perimeter using multiple different sensors 150. In some cases, the sensors 150 conform to one or more residential-specific standards that have been listed by a Nationally Recognized Testing Laboratory (NRTL), such as Underwriters Laboratories, Inc. Examples of applicable standards can include UL 639, UL 636, UL 268, UL 2034 and/or UL 2075. In some cases, sensors 150 conforming to residential-specific standards cannot be installed in a commercial premises. Likewise, in some cases, sensors 150 conforming to commercial-specific standards cannot be installed in a residential premises.

Based on the measurement data received from the sensors 150, the control module 110 determines if one or more trigger conditions are met. The control module 110 can consider different criteria in order to make this determination. For example, the control module 110 can determine if one or more of the received measurements falls outside of an acceptable range (e.g., if the measured concentration of carbon monoxide measurements exceeds a particular threshold concentration, if the measured amount of motion exceeds a particular threshold amount of motion, if the measured amount of smoke exceeds a particular threshold amount of smoke, and so forth). In some cases, the control module 110 can determine if multiple criteria are met (e.g., if at approximately the same time, the measured concentration of carbon monoxide measurements exceeds a particular threshold concentration and the measured amount of smoke exceeds a particular threshold amount of smoke). In some cases, the control module 110 can include additional criteria for determining if a trigger condition is met. For example, the control module 110 can make a determination based on the time and/or date, whether or not the user has instructed the alarm system to provide notifications (e.g., by "arming" or "disarming" the system), and so forth. In some cases, the control module 110 can select, from among several possible trigger conditions, a specific trigger condition that has been met. For example the control module 110 might determine that a fire condition has been met based on the fulfillment of certain criteria, and that a burglary condition has been met based on the fulfillment of other criteria. In some cases, the control module 110 can make determinations in a manner that conforms to one or more residential-specific standards, such as UL 1023 and/or UL 985 and/or UL 1635. For example, in some instances, the control module 110 can determine that a trigger condition has been met if measurements from the sensors 150 indicate a hazardous situation, if the control module 110 has not received an acknowledgement command from the user within a particular length of time (e.g., 15 seconds after a pre-alarm warning is presented by the control module 110), and if the control module 110 has not been manually reset within a particular length of time after receipt of an authorized acknowledgement command from a user (e.g., 30 to 60 seconds after receipt of the acknowledgment command).

Upon determining that one or more trigger conditions are met, the control module 110 transmits a trigger input to the supervisor module 120. These trigger outputs indicate whether a trigger condition has been met, and in some cases, identify the specific trigger condition that has been met. For example, if the control module 110 determines that a fire condition has been met, the control module 110 can transmit a trigger input that is specific to a fire condition. In some cases, the trigger input can identify a location. For example, if the control module 110 determines that a trigger condition has been met at a particular location's sensors, the control module 110 can transmit a trigger input that is specific to that particular location. In some cases, the trigger input conforms to one or more residential-specific standards, such as UL 1023 and/or UL 985, and/or UL 1635. For instance, in some cases, the trigger inputs are signals having a voltage of 12 V. In some cases, particular signals can be used to indicate particular conditions. For example, a "temporal 3" signal can be used to indicate a fire condition, while a "temporal 4" signal can be used to indicate an excessive carbon monoxide condition.

The supervisor module 120 receives the trigger input from the control module 110, and selects one or more of the notification devices 140*a-d* to activate. When activated, the notification devices 140*a-d* generate a notification (e.g., an auditory and/or visual notification), informing the user of the condition. In some cases, the notification devices conform to one or more residential-specific standards, such as UL 1023 and/or UL 985 and/or UL 1635. For instance, in some cases, the notification devices are configured to operate at a voltage of 12 V. In some cases, the notification devices are configured such that they are capable of emitting an auditory notification that is at least 15 dBA above the ambient noise level (or at least 5 dBA above a maximum sound level) for a specific amount of time (e.g., 60 seconds). These measurements can be taken from particular critical areas of the premises (e.g., inside the location of the occupants' bedroom, and within each of the occupied rooms, and so forth). In some cases, the notification device can configured to provide instructions when activated, for example by generating specific tones, patterns of tones, and/or spoken messages that convey directions to the occupants of the protected premises (e.g., evacuation directions). Different instructions can be generated based on the particular situation and/or by the type of emergency that has been detected by the alarm system. For example, instructions can be generated in the event of a fire, burglary or carbon monoxide emergency.

In some cases, the notification devices 140*a-d* can be electrically coupled to the supervisor module 120 through a two-wire system. In a two-wire system, the supervisor module 120 applies an electric current to an outgoing wire leading to the notification devices, and an incoming wire from the notification devices provides a pathway for current to return to the supervisor module 120. In some cases, one of more of the notification devices 140*a-d* can be polarized, such that current can only flow in one direction through it. When the polarization of the current aligns with that of the notification device, current flows through the notification device and activates it. In response, the notification device generates a notification. When the polarization of the current does not align with that of the notification device, current cannot flow through the notification device. As a result, the notification device is inactive, and does not generate a notification.

Multiple notification devices 140*a-d* can be electrically coupled to a single electric circuit, such that multiple notification devices 140*a-d* can be activated together. For example, as shown in FIG. 2, two notification devices 140*a-b* are electrically coupled in parallel in a first electric circuit 208*a*, and two notification devices 140*c-d* are electrically coupled in parallel in a second electric circuit 208*b*. In some cases, the electric circuits 208*a-b* can be coupled to the supervisor module 120 at a connection interface within a protected housing (e.g., a housing that encloses the supervisor module 120) and/or protected by insulating tubing (e.g., 0.013 inches, or 0.33 mm of insulating tubing), such that the coupling between the supervisor module 120 and the electric circuits 208*a-b* are protected from the surrounding environment.

In the example shown, the supervisor module 120 is applying a current having a first polarity (current $i_1$) to the electric circuit 208*a*. Current $i_1$ is opposite in polarity to the notification devices 140*a-b*. Thus, no current flows through the notification devices 140*a-b* (indicated by the crossed-out arrows 210*a-b*). As a result, the notification devices 140*a-b* are inactive. Conversely, the supervisor module 120 is applying a current having a second polarity (current $i_2$) to the electric circuit 208*b*. The polarity of current $i_2$ is aligned with that of notification devices 140*c-d*. Thus, current flows through the notification devices 103*c-d* (indicated by the arrows 210*c-d*). As a result, the notification devices 103*c-d* are activated, and generate notifications (e.g., an auditory notification 212*a* and a visual notification 212*b*). In order to selectively activate specific notification devices 140*a-d*, the supervisor module 120 can selectively change the polarity of the current applied to a specific electric circuit 208*a-b*. Thus, the supervisor module 120 can continuously apply a current having an unaligned polarity of each of the electric circuits 208*a-b*, then selectively reverse the polarity of the current applied to one or more of the electric circuits 208*a-b* in order to activate specific groups of notification devices 140*a-d*.

In some cases, the supervisor module 120 can apply a uniform current to the electric circuits 208*a-b* (e.g., a current that does not substantially change over time). In some cases, the supervisor module 120 can apply current according to different patterns. For example, the supervisor module 120 can apply current that continuously or periodically changes in polarity and/or intensity, such that the notification devices 140*a-d* generate a pulsing or warbling sound, or sustained sound. For example, in some cases, the notification devices 140*a-d* can generate pulsing sounds known as "temporal 3" or "temporal 4." In some cases, different patterns of current can be used, such that the notification devices 140*a-d* generate different types of sounds that can be differentiated from one another. For example, a first pulsing sound (e.g., "temporal 3") can be used to indicate a fire, and a second pulsing sound (e.g., temporal 4) can be used to indicate detection of a carbon monoxide emergency, while a warbling or sustained sound can be used to indicate an intruder. In some implementations, the supervisor module 120 can vary the current applied to the electric circuits 208*a-b* based on a trigger output signal (e.g., a negative or positive trigger output signal) received from the control module 110. In some implementations, the supervisor module 120 can apply similar patterns to each of the activated notification devices 140*a-d*, such that they provide similar notifications in uniform manner (e.g., as a pulsating or warbling sound that occurs in unison across several notification devices). In some cases, this can be performed by having the supervisor module 120 "follow" the trigger input provided by the control module 110, such that the current applied to each of the electric circuits 208*a-b* "follows" the trigger input (e.g., programmed for "input to output follower mode" operation).

In some implementations, certain types of notifications take priority over others. For example, if multiple trigger inputs are received, a notification is generated and emitted corresponding to the highest priority trigger input. In some cases, notification indicating fire or carbon monoxide that precedent over notification indicating intrusions. Other priorities are also possible, depending on the implementation.

In some instances, the supervisor module 120 applies current in a manner that conforms to one or more residential-specific standards, such as UL 1023 and/or UL 985 and/or UL 1635. For instance, in some cases, the supervisor module 120 can apply a voltage of 12 V across the electric circuits 208*a-b*, resulting in a current of approximately 1.5 A. As another example, in some cases, the supervisor module 120 can be configured to apply up to a particular maximum amount of power across all of the electric circuits 208*a-b* (e.g., 100 VA), while in some cases, the supervisor module 120 is not limited in this manner.

In some implementations, the electric circuits 208*a-b* conform to one or more residential-specific standards, such as UL 1023 and/or UL 985 and/or UL 1635. For example, in some cases, residential-specific standards limit the amount of current and voltage that can be applied to the electric circuits 208*a-b*, such that the power requirements are more appropriate for a residential setting.

Although two electric circuits are shown, each having two notification devices, this is merely an illustrative example. In practice, an alarm system 100 can have any number of electric circuits (e.g., one, two, three, four, five, and so forth), each having any number of notification devices (e.g., one, two, three, four, five, and so forth). However, in some implementations, the alarm system 100 might be configured to operate a limited number of electric circuits (e.g., up to four), and a limited number of notification devices (e.g., up to twelve). This can be beneficial in some cases, as it can reduce the amount of current drawn by the supervisor module 120. For example, in some cases, a current of up to 4 A can be divided among four electric circuits.

As described above, the supervisor module 120 also monitors the integrity of each notification device 140*a-d* to determine if it functions correctly. This can be performed, for example, using an end of line resistor. For example, as shown in FIG. 2, the electric circuit 208*a* has an end of line resistor 202*a* electrically coupled in parallel with the notification devices 140*a-b*, and the electric circuit 208*b* has an end of line resistor 202*b* electrically coupled in parallel with the notification devices 140*c-d*. When the current applied to an electric circuit is not aligned with that of the notification devices (e.g., as shown in FIG. 2 for electric circuit 208*a*), electric current does not flow through those notification devices. However, electric current flows through the resistor, and returns to the supervisor module 120. Alternatively, when the electric current applied to an electric circuit is aligned with that of the notification devices (e.g., as shown in FIG. 2 for electric circuit 208*b*), electric current flows through those notification devices. Thus, electric current also returns to the supervisor module 120. However, if the electric circuit is damaged such that it cannot carry current properly (e.g., due to open or shorted wiring) or only intermittently carries current (e.g., if the conductive elements of the electric circuit provide an intermittent connection), the amount of current that returns of the supervisor module 120 will differ from the expected amount (e.g., zero returning current, or intermittently varying returning current). Thus, based on the electric current that returns from an electric circuit, the supervisor module 120 can determine if the electric circuit is functioning properly. In some cases, the supervisor module 120 can differentiate between different circuit conditions, such as an open condition, a grounded condition, or a shorted condition.

In some cases, the supervisor module 120 and the end of line resistors 202*a-b* can conform to one or more residential-specific standards, such as UL 1023 and/or UL 985 and/or UL 1635. For example, the resistor can be approximately 2200 ohm resistors. Other resistor values are also possible, depending on the implementation.

The supervisor module 120 also transmits status data to the control module 110. For example, if the supervisor module 120 determines that an electric circuit 208*a-b* is performing abnormally (e.g., due to an absence of returning current or intermittently varying returning current), the supervisor module 120 can transmit a fault signal to the control module 110, indicating this abnormality. In response, the control module 110 can perform an appropriate action. For example, the control module 110 can notify the user of the failure or trouble condition using a display screen, an indicator light, and/or an audio speaker.

In some cases, the status data transmitted by the supervisor module 120 can conform to one or more residential-specific standards, such as UL 1023 and/or UL 985 and/or UL 1635.

As described above, the power source 130 provides electric power to the supervisor module 120, and in some cases, also can provide electric power to one or more of the other components of the alarm system 100 as well. As shown in FIG. 2, in some implementations, the power source 130 is electrically coupled with a transformer 204, such that electric power provided by the power source 130 is transformed before it is provided to the supervisor module 120. For instance, in some cases, the power source 130 is a remotely located source of power (e.g., an electric generator or a regional electrical grid) that is electrically coupled to a household electrical system. A transformer can be used to transform electric power from the household electric system into transformed power, then input the transformed power into the supervisor module 120. For example, in some cases, the transformer 204 can transform 120 VAC electric power into transformed electric power having a voltage of approximately 12 to 16 VDC (e.g., between 12.2 to 14.4 VDC) and a current of approximately 2.5 amps or more, and input the transformed power to the supervisor module 120. In some cases, the transformer 204 need not be polarity-sensitive.

A transformed power output having a voltage of approximately 12 to 16 VDC is beneficial in various circumstances, as it allows the transformer to be relatively small, and relatively easy to install (e.g., without the need of an electrician). For example, a transformer 204 having an output of approximately 12 to 16 VDC, in some cases, can be approximately the size of a notebook computer charger, and can be installed by plugging a transformer into a household electrical outlet. In comparison, a transformed power output having a relatively high voltage (e.g., 24 V) may require a comparatively larger transformer that is more difficult to install. For example, a transformer having an output of 24 VDC, in some cases, requires an open-frame transformer that is installed into a household electrical system directly. In many cases, an open-frame transformer also must be located inside a physical housing of a control cabinet. This can result in increased time and expense to install the alarm system 100, and can limit the potential locations where the transformer 204 and the supervisor module 130 can be installed. Likewise, in some cases, there may be a greater risk of shock due to the higher voltage being utilized to and within the open frame transformer.

In some cases, the transformer 204 can be plugged into a household electrical outlet, and restrained to the outlet so that the plug of the transformer 204 cannot be accidentally plugged out. In some instances, the transformer 204 may be listed by a nationally recognized testing laboratory (e.g., UL or ETL). In some implementations, the transformer 204 conforms to one or more residential-specific standards, such as UL 1023 and/or UL 985 and/or UL 1635. For example, a transformer 204 conforming to residential-specific standards might have a relatively lower voltage output (e.g., between approximately 12 V and 16 V, or between 12 V and 24 V) compared to that of a transformer used for commercial-specific purposes (e.g., approximately 24 V or more). As another example, a transformer 204 conforming to residential-specific standards might not have the same installation requirements. For instance, a transformer 204 conforming to residential-specific standards might not require a dedicated lockable circuit breaker, and might not require specialized high voltage wiring within a protective raceway, both of which might be required for commercial-specific standards. Thus, a transformer 204 conforming to residential standards may be purchased at a lower cost, and/or installed more easily.

In some cases, the control module 110 and the supervisor module 120 are powered independently. For example, although the control module 110 transmits trigger inputs to the supervisor module 120 having a particular voltage and current, the supervisor module 120 might draw electric power from the power source 130 and transformer 204 in order to activate the notification devices 140*a-d*. This feature can be beneficial, for example, if several notification devices 140*a-d* are used and/or notification device 140*a-d* draw a relatively large amount of current. By powering the supervisor module 120 independently (e.g., rather than relying on the trigger inputs of the control module 110 for electric power), this allows the supervisor module 120 to monitor and/or activate the notification devices 140*a-d* more reliably. Similarly, this allows the supervisor module 120 to independently supervise one or more of the components, as well as the electrical connections between them.

In some cases, the supervisor module includes a rechargeable battery that provides backup power to the supervisor module 120 and, in some cases, one or more other components of the alarm system 100. This feature can be beneficial, as it allows the supervisor module 120 to continue to operate, even in the event of a failure of power source 130 and/or transformer 204. As shown in FIG. 2, in some implementations, the supervisor module 120 includes a battery 206 that is electrically coupled with a transformer 204, such that at least a portion of the electric power provided by the transformer 204 is used to electrically charge the battery 206 (e.g., through a built in battery charger module). In the event that the power received from the transformer 204 is insufficient to adequately power the supervisor module 120, the supervisor module 120 can automatically switch over to the battery 206, draw electric power from the battery 206 instead. The battery 206 can be configured to provide varying amounts of backup power. For example, in some cases, the battery can provide enough electric power to maintain the operation of the supervisor module 120 for at least a certain amount of time when no notification devices are active (e.g., at least 24 hours), and allow the supervisor module 120 to activate the notification devices for a certain amount of time (e.g., four minutes or more) during an alarm condition In some cases, the battery 206 204 conforms to one or more residential-specific standards, such as UL 1023 and/or UL 985 and/or UL 1635. For instance, the battery 206 can be configured such that it is capable of providing electrical power at a voltage of 12 V and with a current of 7 A. In some instances, the battery can be a lead acid battery, gel cell batteries, nickel cadmium battery, nickel metal hydride battery, lithium ion battery, or lithium polymer battery. In some implementations, multiple batteries can be used.

In some cases, the supervisor module 120 also can determine if the alarm system 100 has access to a sufficient amount of electric power to properly function. If any abnormalities are detected (e.g., due to a partial or complete failure of power source 130, transformer 204, and/to battery 206), the supervisor module 120 also can transmit status data (e.g., fault signals) indicating these abnormalities to the control module 110. The supervisor module 120 can also detect abnormalities based on other criteria, such as a low battery, and/or abnormalities with the functional and operational condition of the respective outputs that connect to the notification devices 140*a-d*. For example, the supervisor module 120 can be configured detect different types of failures, as elaborated to above, including, but not limited to the state of the power source 130 and transformer 204, if the supervisor module 120 detects that no electric power has been received by these devices for a period of time (e.g., several seconds or minutes, depending on the requirements of the authority having jurisdiction), and if an insufficient amount of electric power has been received by these devices for a period of time (e.g., if less than an acceptable amount of voltage is detected). In some cases, the supervisor module 120 can also consider a delay setting (e.g., 2.5 to 3 hours) such that if the abnormal condition or fault is not restored within a specified period of time, only then does it report this change of state to the control module 110. Although example times are described, in practice, different times can also be used, depending on the implementation, and the requirements of the authority having jurisdiction.

In some instances, the supervisor module 120 also includes status indicators that indicate the operational status of the supervisor module 120. For example, as shown in FIG. 2, some implementations of the supervisor module 120 includes status indicators 214. Status indicators 214 can include, as examples, one or more devices (e.g., LEDs) that emit light having one or more different colors (e.g., red and green). The light emitted by the status indicators 214 may change, depending on the operational status of the supervisor module 120. As an example, if the supervisor module 120 determines that it is receiving sufficient power from the power source 130 and the transformer 204 to operate, a green LED can illuminate. If the supervisor module 120 is not receiving a sufficient amount of power from the power source 130 and the transformer 204 to operate, a red LED will illuminate. As another example, if a particular electric circuit 208*a-b* is performing abnormally, a red LED can illuminate. If a particular electric circuit 208*a-b* is performing normally, a green LED can illuminate. Thus, a particular color (e.g., green) can be used to indicate a normal condition, and another color (e.g., red) can be used to indicate a fault, trouble, or abnormal condition. In some implementations, one or more LEDs can be positioned on the supervisor module 120 in proximity with certain input ports or terminals (e.g., an input port for receiving electric power, or the input port for each of the electric circuits 208*a-b*). These LEDs can be used to indicate the operational status of that particular port or terminal (e.g., if adequate power is being received at the port or terminal, if the electric circuit is performing abnormally, if the battery 206 is not operating as intended, and/or if one or more of the electric outputs for the electric circuits 208*a-b* is not functional).

In some cases, a control module 110 can be configured such that measurement data and notifications are organized according to particular "zones." For example, a control module 110 might define several zones, each corresponding to a particular area of a protected premises (e.g., a bedroom, a kitchen, a living room, and so forth). Measurement data received from the sensors 150 can be organized according to these zones, such that the control module 110 can determine more specifically the region or area of the protected premises corresponding to each measurement or condition of a particular sensor or groups of sensors. In some cases, the control module also can selectively display information regarding each zone (e.g., using a keypad, display screen, or indicator lights), such as to indicate the status of each specific zone (e.g., if an abnormal condition has been detected with respect to that zone, or if the zone is in a normal or clear condition). In some cases, the status data from the supervisor module 120 can also be organized and displayed in this manner as well. For instance, the control module 110 might assign one or more zones to the supervisor module 120. Based on the status data received from the supervisor module 120, the control module 110 can display information with respect to the appropriate zones. As an example, the control module 110 and supervisor module 120 can be configured such that each electric circuit having notification devices (e.g., electric circuit 208*a-b*) is assigned a specific zone (e.g., "zone 1" and "zone 2," respectively). If the supervisor module 120 determines a particular electric circuit is behaving abnormally (e.g., electric circuit 208*a*), it can automatically transmit a fault signal to the control module 110 identifying the condition or status of the particular electric circuit. In response, the control module 110 can display this information with respect to the appropriate zone (e.g., "zone 1"). This can be beneficial in some cases, as it allows a user to quickly identify abnormalities in the alarm system 100, and take an appropriate course of action to restore a system impairment, before an emergency occurs.

In some cases, the supervisor module 120 includes individual signal output interfaces for each electric circuit being monitored. Each of these interfaces can be used as a dedicated interface for outputting status data regarding a specific electric circuit. As an example, for the implementation shown in FIG. 2, the supervisor module 120 can include a signal output interface dedicated to outputting status data regarding the electric circuit 208*a*, and a different signal output interface dedicated to outputting status data regarding the electric circuit 208*b*. Each of these signal output interfaces can be individually coupled to the control module 110. This can be beneficial, for example, when the control module 110 provides an individual signal input interface for each "zone." In this case, each signal output interface of the supervisor module 120 can be electrically coupled to a corresponding signal input interface of the control module 110, such that status data from each electric circuit is presented according to a dedicated zone.

In some cases, the supervisor module 120 can include additional signal output interfaces corresponding to other aspects of the supervisor module 120. For example, the supervisor module 120 may include a dedicated signal output interface that output status data regarding the state of the power source 130 and/or of the transformer 204, and/or a second dedicated signal output interface that output status data regarding the state of the battery 206.

In some implementations, the signal output interfaces are provided with a "normally open" configuration. For example, during normal operation, the signal output interface provides an open circuit. If the supervisor module 120 detects a faulty condition, the signal output interface provides a closed circuit. Conversely, in some implementations, the signal output interface can be provided with a "normally closed" configuration. For example, during normal operation, the signal output interface provides a closed circuit. If the supervisor module 120 detects a faulty condition, the signal output interface provides an open circuit. Thus, in some cases, communication between the control module 110 and the supervisor module 120 can be provided in the form of circuits that open or closed based on the presence or absence of faulty conditions. In some implementations, the supervisor module 120 can include both "normally closed" and "normally open" signal output interfaces, such that a user can select an appropriate interface during installation. For example, each signal output interface can include a common terminal, a "normally open" terminal," and a "normally closed" terminal (e.g., a form C contact capable of conveying an electric signal having a voltage of 12-18 VDC and a current of 1 amp, or through the use of a dry contact closure) and it can be electrically coupled between the supervisor module 120 and the control module 110, using a subset of these appropriate terminals.

In some implementations, the supervisor module 120 also includes a memory module that stores a record of each of the abnormal conditions that were detected. Thus, even if an abnormal condition is intermittent and later corrects itself (e.g., due an intermittent problem), a record is still retained of that abnormality for future reference (e.g., for troubleshooting purposes). In some cases, this memory can be selectively erased by a user (e.g., through an on-board reset button).

As described above, in some cases, the supervisor module 120 provides electric power to activate the notification devices 140*a-d* (e.g., by applying current to the electric circuits 208*a-b* using electric power from the power source 130 and transformer 204 and/or the battery 206). However, in some implementations, the notification devices 140*a-d* can be activated using additional power received from an additional power source. This additional power can be used to supplement or "boost" the power received from the supervisor module 120. This can be beneficial, for example, in situations where the alarm system 100 includes a large number of notification devices and/or notification devices that draw a relatively large amount of power. In these situations, the additional source of power can provide sufficient supplemental power, such that the supervisor module 120 and each of the notification devices can operate normally. This also can be beneficial, for example, in situations where the notification devices are positioned relatively distant from the supervisor module 120, and experience line losses and/or voltage drop conditions, which may impact the operation of the device. For example, line losses can often lead to a drop in voltage across the notification devices, which can result in an auditory notification that is more quiet than desired, a visual notification that is less bright than desired, or no notifications at all. An additional source of power can be positioned in relatively close proximity to one or more of the notification devices in order to reduce the effects of these line losses.

In the examples above, the control module 110 is described as transmitting a trigger input to the supervisor module 120 in the form of an electrical signal (e.g., a 12 V signal). In some cases, a trigger input need not be such a signal. For example, in some cases, an electrical interface between the control module 110 and the supervisor module 120 can be provided in a "dry-closure" configuration (e.g., a closed circuit with no voltage applied across that circuit). The control module 110 can also send a trigger input by opening that circuit. In response to detecting the open circuit, the supervisor module 120 can determine that a trigger input has been received, and can activate one or more of the notification devices 140*a-d* accordingly. In some cases, the supervisor module 120 can be compatible with both "dry-closure" configurations and electrical signal configurations, depending on the implementation. In some cases, this functionality can be modified, for example using dip-switches or an input interface.

In some cases, the control module 110 and/or the supervisor module can monitor the integrity of other devices of the alarm system 100. For example, the control module 110 can determine if the electrical connection interfaces between the sensors 150 and the control module 110 are open, grounded, and/or shorted. If so, the control module 110 can determine that a trigger condition is met, and generate an appropriate notification indication or message. As another example, the control module 110 can determine if the electrical connection interfaces between the supervisor module 120 and the control module 110 are open, grounded, and/or shorted. If so, the control module 110 can determine that a trigger condition is met, and generate an appropriate notification indication or message.

In some instances, upon detecting an abnormality, the control module 110 can display a notification message to the user (e.g., using a display screen or indicator light), but not generate an audible notification message using the notification devices 140*a-d*. For example, if a short, ground, or open connection is detected between a sensor 150 and the control module 110, or if an abnormality with an electric circuit 208*a-b* is detected, the control module 110 can display a notification message to the user, but not generate an audible notification message using the notification devices 140*a-d*. Thus, the control module 110 can notify users and/or a remote monitoring station in different ways based on the severity of the problem, such that the intrusiveness of the alarm or trouble corresponds to the level of severity of the condition. For example, the detection of a trouble condition regarding the electronic circuits 208*a-b* might not require the police or fire department to be dispatched by the remote monitoring station. In contrast, when a serious emergency exists (e.g., a fire or burglary), the audible alarms can be activated and the remote station can be notified simultaneously. Although an example situation is described above, other combinations of abnormalities and notifications can be used, depending on the implementation.

In some cases, the supervisor module 120 can detect abnormalities different from, or in addition to, those described above. For example, in some implementations, the supervisor module 120 can include a designated screw terminal to provide an electrical ground (e.g., in accordance with National Electrical Code (NEC), and NFPA 70). The supervisor module 120 can be configured to detect faults with this grounding (e.g., by detecting if an electrically conducting connection exists between an ungrounded conductor and the normally non-current-carrying conductor). Based on this detection capability, the supervisor module 120 can send status data (e.g., fault signals) to the control module 110, indicating the abnormality. In some cases, the ground fault maximum test impedance can be approximately 1000 ohms. In some cases, the supervisor module 120 can be configured to operate during a single break or single ground fault condition, and can be self-adjusting in the event that the fault restores, and can be self-restoring when the break or fault is corrected as well.

In some cases, the supervisor module 120 can also include thermal and short circuit protection. In the event that it detects a thermal or short circuit, electric power can be interrupted (e.g., through an auto-reset relay) in order to reduce the likelihood of damage to the supervisor module 120.

In some cases, the supervisor module 120 can be configured to withstand abnormal electrical input to live or exposed portions of the device. For example, in some cases, the supervisor module 120 can be configured to withstand 500 VAC (or 707 VDC) for at least one minute without failure. In some cases, the supervisor module 120 can be configured to withstand other voltages, for example 1000 VAC (or 1414 VDC) or more.

In some above examples, signals are described as being transmitted between components one at a time. However, in practice, any number of signals can be transmitted and received in an overlapping manner. In some cases, signals can be transmitted using an active multiplex system, and can include a means for positively identifying each signal. For example, in some cases, upon receiving a signal, a component can transmit a response that positively indicates that the signal was successfully received. In some cases, each transmission also includes identification information that describes the component from which the signal originated, the status of that component, and/or other identifying status or information.

Although several example features of the alarm system 100 are described above, in practice, each implementation of the alarm system 100 need not include each and every one of these features. This may be beneficial, in some cases, to limit the number of features implanted on the alarm system 100, as it can potentially decrease the complexity of the alarm system 100, and can potentially reduce the cost of manufacturing and/or installing the alarm system 100. For example, for implementations of the alarm system 100 that are intended to be installed in a residential environment, in some cases, the supervisor module 120 can be configured such that it is only capable of interacting with notification devices that generate audible notifications (rather than being capable of interacting with notification devices that generate visual notifications as well). In a similar vein, in some cases, the supervisor module 120 can be configured such that it is only capable of generating notifications by applying a 12 V signal to an electric circuit (rather than also being capable of generating notifications by applying a 24V signal to an electric circuit). By limiting the functionality in this manner, the supervisor module 120 can include features that have a greater likelihood of being used in a residential environment (e.g., managing audio-based notification devices using 12 V signals), while not including features that have a lesser likelihood of being used in a residential environment (e.g., managing visual-based notification devices and/or using 24 V signals). In practice, other limitations also can be introduced in order reduce the complexity and cost of manufacturing and/or installing the supervisor module 120.

Figure 3:
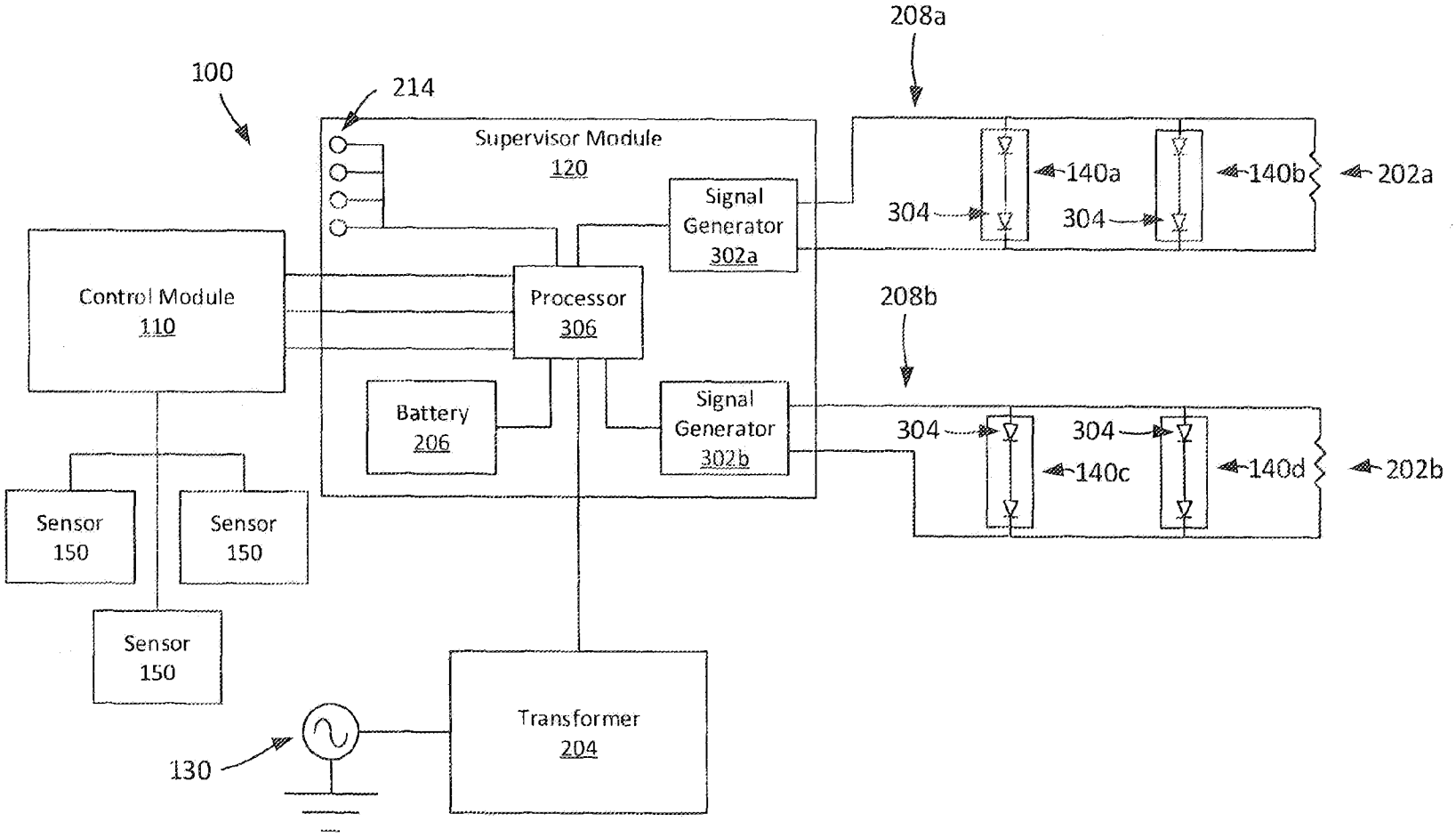
FIG. 3 is a diagram of another example alarm system.

The alarm system 100 shown in FIGS. 1 and 2 can be implemented in various ways. For instance, an example implementation of the alarm system 100 is shown in FIG. 3. In this example, the alarm system 100 includes a control module 110, a supervisor module 120, a power source 130, multiple notification devices 140*a-d*, resistors 202*a-b*, a transformer 204, a battery 206, electric circuits 208*b-c*, and status indicators 214. In general, each of the components of the alarm system 100 can have similar functionality as those described with respect to FIGS. 1-2.

For example, the control module 110 controls various aspects of the alarm system 100, and can provide measurement information from one or more sensors 150 in order to determine if a trigger or alarm condition has been met (e.g., if a particular threshold has been met or exceeded). As shown in FIG. 3, in this example, each of the sensors 150 is individually coupled to the control module 110, such that each transmits measurements individually over a dedicated transmission line (e.g., a conductive wire or trace). In practice, other wiring configurations are also possible, depending on the implementation. Similarly, in some cases, implementation of wireless transmission is also possible.

Based on these measurements, the control module 110 determines if a trigger condition has been met. If one or more trigger conditions have been achieved, the control module 110 transmits a trigger signal to the supervisor module 120, indicating that one or more notification devices 140*a-d* should be activated to alert the occupants of the protected premises of this particular type of emergency alarm condition. As shown in FIG. 3, in this example, the control module 110 can be electrically coupled to a processor 306 of the supervisor module though one or more transmission lines (e.g., through one or more conductive wires or traces), and/or wirelessly, in accordance with NFPA 72 of the National Fire Alarm Code and NFPA of the National Fire Alarm and Signaling Code, such that this information is transmitted between the control module 110 and the processor 306. As indicated above, in some cases, each transmission line between the control module 110 and the supervisor module 120 can correspond to a particular "zone," such that an alarm or trigger condition associated with a particular zone is transmitted over a corresponding dedicated transmission line. In practice, other wiring configurations and wireless configurations are also possible, depending on the implementation.

Based on the trigger signal received from the control module 110, the processor 306 selects an appropriate group of notification devices 140*a-d*, and activates them in order to generate a notification. In the example shown in FIG. 3, the notification devices 140*a-d* each include one or more diodes 304, such that current can only flow across the notification devices 140*a-d* in a single direction. When the signal generators 302*a-b* apply electric current at a first polarity to the electric circuits 208*b-c* (e.g., by inducing electric current in a first direction in the electric circuits), electric current is restricted by the diodes 304, and does not flow through the notification devices 140*a-d*. When the processor 306 determines that a particular group of notification devices 140*a-d* should be activated, the processor 306 sends electronic data or instructions to the appropriate signal generator 302*a-b*, instructing it to reverse the polarity of the applied electric current. When the selected signal generator 302*a-b* reverses the polarity of the applied electric current (e.g., by inducing electric current in a second direction in the electric circuits opposite the first direction), the electric current is no longer restricted by the diodes 304, and is allowed to flow through the selected notification devices 140*a-d*. Accordingly, a notification is generated by the selected notification devices 140*a-d* (e.g., an audible and/or visual notification).

As shown in FIG. 3, the electric circuits 208*a-b* also include resistors 208*a-b*, respectively. If the electric circuits 208*a-b* are intact, electric current applied to the electric circuits will return to the signal generators 302*a-b*, even if the polarity is opposite that needed to flow past the diodes 304. Conversely, if the electric circuits 208*a-b* are not intact, electric current applied to the electric circuits will not return to the signal generators 302*a-b*. Thus, by measuring the electric current that returns from the electric circuits 208*a-b* (e.g., using the signal generators 302*a-b*), the processor 306 can determine if one or more of the electric circuits are not intact, making them non-functional. In response to this determination, the processor 306 can transmit appropriate status data (e.g., a fault signal indicating an abnormality) to the control module 110.

As shown in FIG. 3, the supervisor module 120 also includes several status indicators 214. As described above, each of the status indicators 214 can individually provide information regarding a particular aspect of the supervisor module 120. For example, in some cases, each status indicator 214 can be a light (e.g., a single or multi-color LED) that indicates when particular portions of the supervisor module 120 are operating as expected, or if particular portions of the supervisor module 120 are not operating as expected. In some cases, one or more of the status indicators 214 can indicate if an abnormality is detected in the electric circuits 208*a-b*. In some cases, each of these status indicators 214 can be individually coupled to the processor 306, and each can be controlled by the processor 306 in order to present information to the user.

As shown in FIG. 3, in this example, the power source 130 is an AC power source (e.g., a 120 VAC power source, such as what is often found on household electrical system). The transformer 204 receives electric power from the power source, then converts the electric power into transformed electric power. The transformed electric power is then input into the supervisor module 120. In some cases, the transformed power that is input into the supervisor module 120 can monitored and/or managed by the processor 306. For example, the processor 306 can be coupled to the transformer 204 in such a way that it can measure the incoming electric power, divert at least a portion of the electric power to charging the battery 206, and/or use at least a portion of the electric power to power the components of the supervisor module 120 (e.g., the processor 306, the signal generators 302*a-b*).

Although an example implementation of an alarm system 100 is shown in FIG. 3, this is merely an illustrative example. Further, although example electrical connections are shown in FIG. 3, these are also merely illustrative examples. In practice, an alarm system 100 can be implemented using different arrangements of components coupled in similar or different ways than described above.

Some implementations of the subject matter and operations described in this specification can be implemented in digital electronic circuitry, or in computer software, firmware, or hardware, including the structures disclosed in this specification and their structural equivalents, or in combinations of one or more of them. For example, in some implementations, control module 110 and supervisor module 120 can be implemented using digital electronic circuitry, or in computer software, firmware, or hardware, or in combinations of one or more of them.

Some implementations described in this specification can be implemented as one or more groups or modules of digital electronic circuitry, computer software, firmware, or hardware, or in combinations of one or more of them. Although different modules can be used, each module need not be distinct, and multiple modules can be implemented on the same digital electronic circuitry, computer software, firmware, or hardware, or combination thereof.

Some implementations described in this specification can be implemented as one or more computer programs, i.e., one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. The processor and the memory can be supplemented by, or incorporated in, special purpose logic circuitry.

To provide for interaction with a user, operations can be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A computer system may include a single computing device, or multiple computers that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective computers and having a client-server relationship to each other.

A number of implementations have been described. Nevertheless, it will be understood that various modifications may be made without departing from the spirit and scope of the disclosure. Accordingly, other implementations are within the scope of the following claims.

What is claimed is:

1. A system comprising:

a control module;

two or more electric circuits, each electric circuit comprising a resistor and one or more notification devices in parallel; and a supervisor module electrically coupled to the control module and the electric circuits;

wherein the supervisor module is configured to:

receive input electric power, the input electric power having a voltage in a range of 12 to 16 VDC;

apply, to each electric circuit, first electric power having a first polarity and a voltage of approximately 12 VDC;

determine, based on electric power returning from each electric circuit, whether any of the electric circuits is damaged;

receive, from the control module, a trigger signal indicative of an alarm event; and responsive to receiving the trigger signal, selectively apply, to a subset of the electric circuits, second electric power having a second polarity opposite the first polarity and a voltage of approximately 12 V, wherein the second electric power comprises a pulsating electrical current, wherein each notification device is configured to allow the electric current to flow through the notification device when the second electric power is applied to the corresponding electric circuit, and wherein the flow of electric current causes the notification device to generate a pulsating notification.

2. The system of claim 1, wherein each notification device is configured to restrict a flow of electric current through the notification device when the first electric power is applied to the corresponding electric circuit.

3. The system of claim 1, wherein the pulsating notification comprises an auditory alert.

4. The system of claim 1, further comprising a transformer, wherein the transformer is configured to:

convert electric power received from a power source into the input electric power, wherein the electric power received from the power source has a voltage of approximately 120 VAC; and apply the input electric power to the supervisor module.

5. The system of claim 4, wherein the transformer comprises an electrical plug configured to be insertable into a household electric socket, and wherein the transformer is configured to convert electric power received from the household electric socket into the input electric power.

6. The system of claim 1, wherein the supervisor module is further configured to:

determine whether an operational state of one or more electric circuits corresponds to a fault state; and responsive to determining that the operational state of one or more electric circuits corresponds to a fault state, transmitting a fault signal to the control module.

7. The system of claim 6, wherein determining that the operational state of one or more electric circuits corresponds to a fault state comprises determining that no electrical power is returning from the one or more electric circuits.

8. The system of claim 1, wherein the supervisor module comprises a battery module;

wherein the supervisor module is further configured to electrically charge the battery module using at least a portion of the input electric power; and wherein the battery module is configured to provide backup electrical power to the supervisor module.

9. The system of claim 8, wherein the supervisor module is further configured to:

determine an operational state of the battery module; and responsive to determining that the operational state of battery module corresponds to a fault state, transmitting a fault signal to the control module.

10. The system of claim 9, wherein determining that the operational state of the battery module corresponds to a fault state comprises determining that the battery module is depleted.

11. The apparatus of claim 10, wherein the pulsating notification comprises an auditory alert.

12. The apparatus of claim 10, wherein the system is configured to operate in accordance with a residential industry standard.

13. The apparatus of claim 12, wherein the residential industry standard is one of UL 985, UL 1635, and UL 1023.

14. The apparatus of claim 10, wherein the supervisor module is further configured to:

determine whether an operational state of the electric circuits corresponds to a fault state; and responsive to determining that the operational state of one or more electric circuits corresponds to a fault state, generating a fault signal.

15. The apparatus of claim 14, wherein determining that the operational state of the electric circuits corresponds to a fault state comprises determining that no electric current is returning from the electric circuit.

16. The system of claim 1, wherein, for each electric circuit, the resistor of the electric circuit is in parallel with each of the one or more notification devices of the electric circuit.

17. The system of claim 1, wherein the pulsating electrical current periodically changes in intensity over time.

18. The system of claim 1, wherein the pulsating electrical current periodically changes in polarity over time.

19. An apparatus for monitoring an electric circuit of an alarm system, the apparatus comprising:

a supervisor module electrically coupled to two or more electric circuits, each electric circuit comprising a resistor and one or more notification devices in parallel;

wherein the supervisor module is configured to:

receive input electric power, the input electric power having a voltage in a range of 12 to 16 VDC;

apply, to each electric circuit, first electric current in a first direction, wherein the voltage across the electric circuit is approximately 12 VDC when the first electric current is being applied;

determine, based on electric current returning from each electric circuit, whether any of the electric circuits is damaged;

receive a trigger signal indicative of an alarm event; and responsive to receiving the trigger signal, selectively apply, to a subset of the electric circuits, second electric current in a second direction opposite the first direction, wherein the voltage across the electric circuit is approximately 12 V when the second electric current is being applied, wherein the second electric current is a pulsating electrical current, wherein each notification device is configured to allow the second electric current to flow through the notification device when the second electric current is applied to the corresponding electric circuit, and wherein the flow of the second electric current causes the notification device to generate a pulsating notification.

20. The apparatus of claim 10, wherein when the supervisor module applies the first electric current to each of the electric circuits, the notification devices are inactive.

21. A method of monitoring two or more electric circuits of an alarm system, the method comprising:

receiving input electric power, the input electric power having a voltage in a range of 12 to 16 VDC;

applying, to each electric circuit, first electric current in a first direction, wherein the voltage across the electric circuit is approximately 12 VDC when the first electric current is being applied;

determining, based on electric current returning from each electric circuit, whether any of the electric circuits is damaged;

receiving a trigger signal indicative of an alarm event; and responsive to receiving the trigger signal, selectively applying, to a subset of the electric circuits, second electric current in a second direction opposite the first direction, wherein the voltage across the electric circuit is approximately 12 V when the second electric current is being applied, wherein the second electric current is a pulsating electrical current, wherein each notification device is configured to allow the second electric current to flow through the notification device when the second electric current is applied to the corresponding electric circuit, and wherein the flow of the second electric current causes the notification device to generate a pulsating notification.

* * * * *